US005248157A

United States Patent [19]

Rice

[11] Patent Number: 5,248,157

[45] Date of Patent: Sep. 28, 1993

[54] TENT POLE HOISTING APPARATUS

[76] Inventor: Maury Rice, 5348 Shirley Ave., Tarzana, Calif. 91356

[21] Appl. No.: 890,878

[22] Filed: Jun. 1, 1992

[51] Int. Cl.[5] ..... B62C 1/00

[52] U.S. Cl. ..... 280/47.131; 280/79.2; 280/63; 135/905

[58] Field of Search ..... 280/47.131, 47.17, 47.23, 280/47.27, 47.33, 63, 79.2, 79.6; 135/905; 414/444

[56] References Cited

U.S. PATENT DOCUMENTS

| | | | |
|---|---|---|---|
| 792,197 | 6/1905 | Clark | 280/47.131 X |
| 2,500,215 | 3/1950 | Swearingen | 280/79.2 X |
| 2,650,786 | 9/1953 | Platt | 280/47.23 X |
| 2,723,864 | 11/1955 | Schierman | 280/47.33 X |
| 3,064,991 | 11/1962 | Huthsing, Jr. | 280/47.33 X |
| 4,927,117 | 5/1990 | Gainey | 135/88 X |

FOREIGN PATENT DOCUMENTS

| | | | |
|---|---|---|---|
| 818775 | 10/1951 | Fed. Rep. of Germany | 280/47.27 |
| 795087 | 3/1936 | France | 280/47.23 |
| 1322080 | 7/1973 | United Kingdom | 280/47.131 |

*Primary Examiner*—Brian Johnson

*Attorney, Agent, or Firm*—George J. Netter

[57] ABSTRACT

Tent pole hoisting apparatus (10) includes a skid plate (12) having a tent pole (32) end retainer (30). A pair of wheels (16) are mounted via an axle (34) to the skid plate curved portion (22). In use, the end of a tent pole is placed in retainer (30) and the apparatus (10) is pulled via an eye bolt (24) in such direction as to raise the pole and tent.

4 Claims, 2 Drawing Sheets

TENT POLE HOISTING APPARATUS

BACKGROUND

1. Field of the Invention

The present invention relates to the hoisting of tent poles, and, more particularly, to apparatus for aiding in the hoisting of such tent poles.

2. Description of Related Art

In the setting up of tents, and particularly very large tents such as used in circuses, an important function and, according to present day techniques employed, an arduous one is the erection of tent poles to a position where they can fully and safely support the flexible siding and ceiling of the tent. At the present time, the typical way of erecting such tent poles is to place a skid plate underneath the pole and manually move the pole with tenting attached to the upper end to the proper location which, at the same time, requires levering of the tent sides and ceiling to a raised position.

It is therefore a desideratum to provide apparatus which aids in the erection of tent poles while at the same time making the pole hoisting more reliable and less apt to slip and injure those in the vicinity of the pole.

SUMMARY OF THE INVENTION

The tent pole hoisting process includes initially spreading the tent material out flat on a ground plane on which it is desired to erect the tent. Then introducing one or more of the tent poles underneath the spread out tent in a generally horizontal (or slight angle) condition and affixing the upper end of the pole to the connection or force exerting point of the tent material.

The apparatus of the present invention which is used to assist in hoisting the invention includes skid plate means having a relatively flat portion interconnected with a curved or rounded section extending a predetermined amount away from the flat portion. On what is the top of the skid plate means flat portion there is provided a hollow cylindrical open top member of such dimensions as to enable receipt of the lower end of the tent pole therein. A pair of wheels are secured to reinforcing side walls which are affixed to the sides of curved portion. An eye bolt is affixed to the curved portion between the two wheels for releasable interconnection with a hook on a pull cable.

With the lower end of the horizontal tent pole received in the cylindrical member (which may require some adjustment rotation of the skid plate means about the wheels), a pull cable is then interconnected with the eye bolt and the entire apparatus is pulled by a conventional motorized means (e.g., small truck) in such direction as to move the upper end of the tent pole and tent material carried thereby into a generally upright position. During erection of the pole, the skid plate rotates about the wheels until when the pole is fully hoisted and 90° to the ground plane, the wheels barely touch the ground plane and carry, at the most, only a very slight load. At this time suitable pegs are driven into the ground through openings in the plate securing the skid plate means and tent pole at the proper position. Finally, the wheels may be removed and utilized on other apparatus for hoisting of still other tent poles, as may be desired.

DESCRIPTION OF A PREFERRED EMBODIMENT

Figure 1:
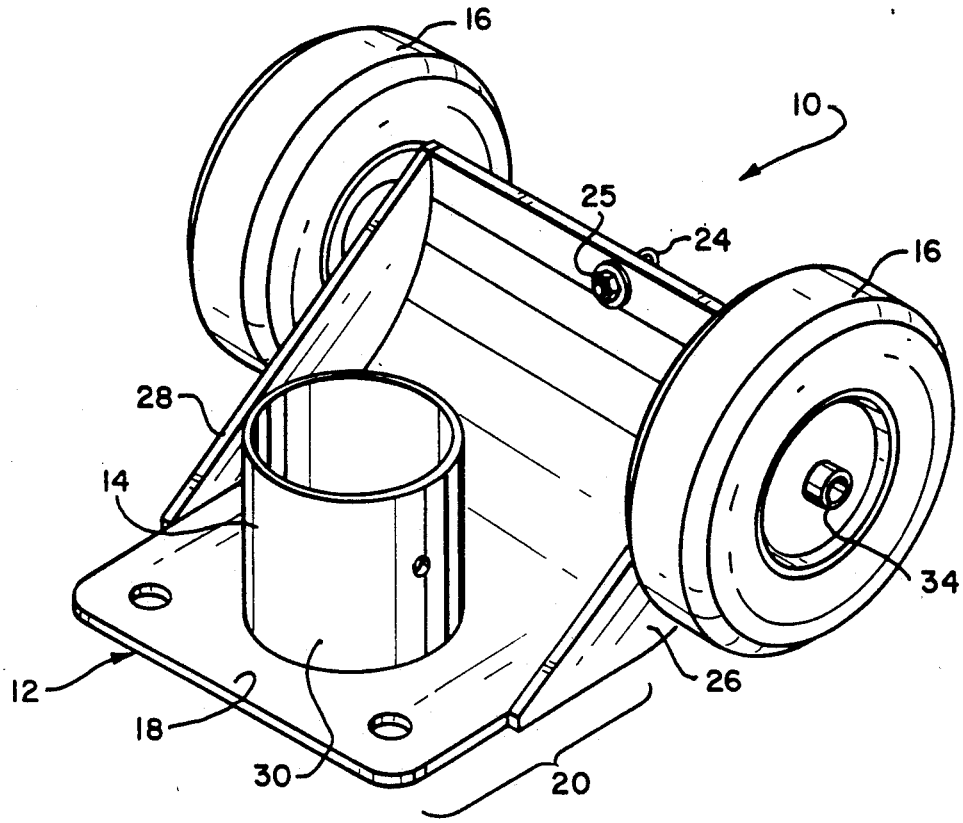
FIG. 1 is a perspective view of the tent pole hoisting apparatus of the present invention.
Figure 2:
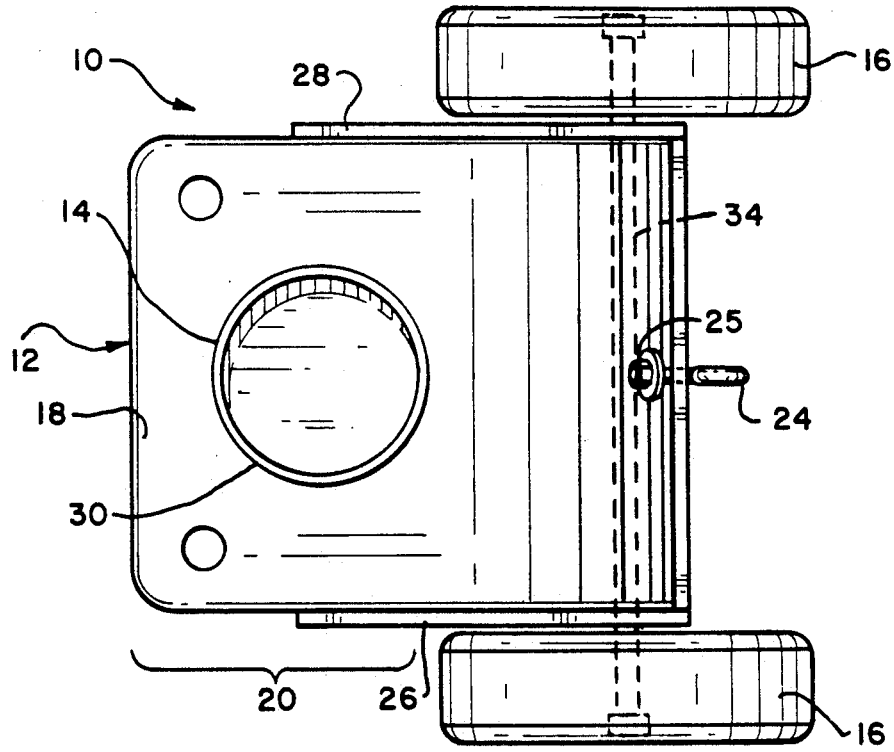
FIG. 2 is a top plan view of the apparatus of FIG. 1.
Figure 3:
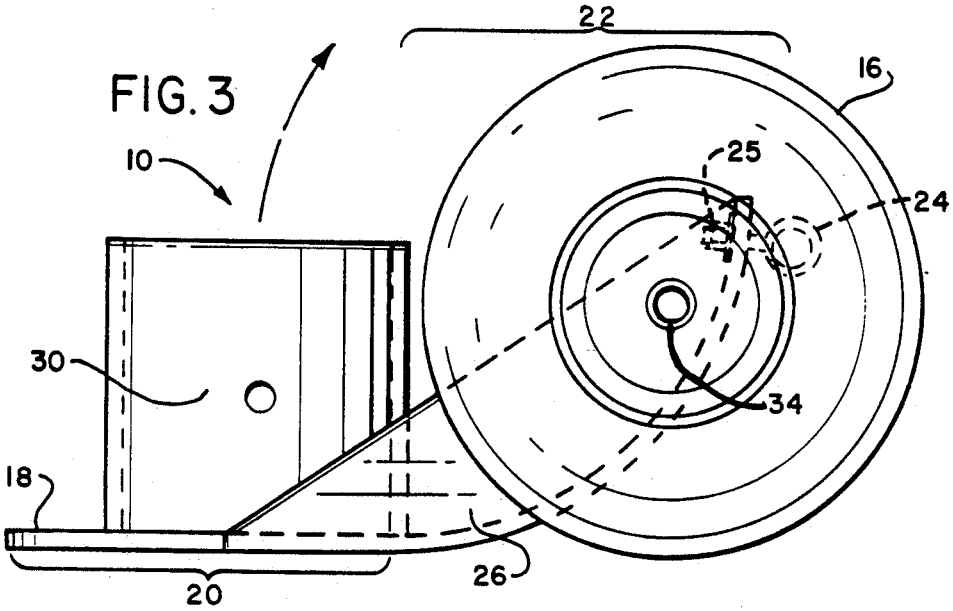
FIG. 3 is a side elevational view of the apparatus.

Turning now to the drawings, and particularly FIGS. 1 through 3, the tent pole hoisting apparatus of the present invention is generally enumerated as 10. More particularly, the invention comprises in its major elements a skid plate means 12 having an upstanding pole end retainer 14 secured thereto and all of which is pivotally mounted onto a pair of wheels 16 enabling ready movement.

With particular reference to FIGS. 2 and 3, it is seen that the skid plate means 12 includes a generally rectangular base plate 18 approximately one-third of which is maintained in a generally flat condition and referenced as 20 while the remainder 22 is curved about a transverse axis so as to extend upwardly and away from the plane of the flat portion 20. At the forward or pulling edge portion of the base plate and substantially centrally located thereon is an eye bolt 24 secured by a threaded means 25. The eye bolt, as will be more particularly described, is used in moving the apparatus of the invention while hoisting a tent pole.

First and second support plates 26 and 28 are affixed to the lateral edges of the base plate 18 across the curved portion 22 and adjacent part of the flat portion 20. In particular, the support plates are continuously secured to the edges of the base plate as by welding, for example, in order to insure strength and maintenance of structural integrity of the apparatus during use.

A hollow metal guide tube 30 has one end secured to the flat portion 20 of the base plate in a somewhat centrally located position and upstanding at substantially 90° therefrom. The inner diameter of the guide tube is such as to readily receive the end portion of a tent pole 32 in use (FIG. 4).

The wheels 16 are mounted on an axle 34 which extends through receiving openings in the two reinforcing plates on the same side of the base plate as the guide tube 30. The diameter of the wheels is such and the axle is so mounted that when the base plate flat portion 20 is flush with the ground plane (FIG. 6) the wheels barely contact the ground plane and can be removed from the apparatus for other use.

Figure 4:
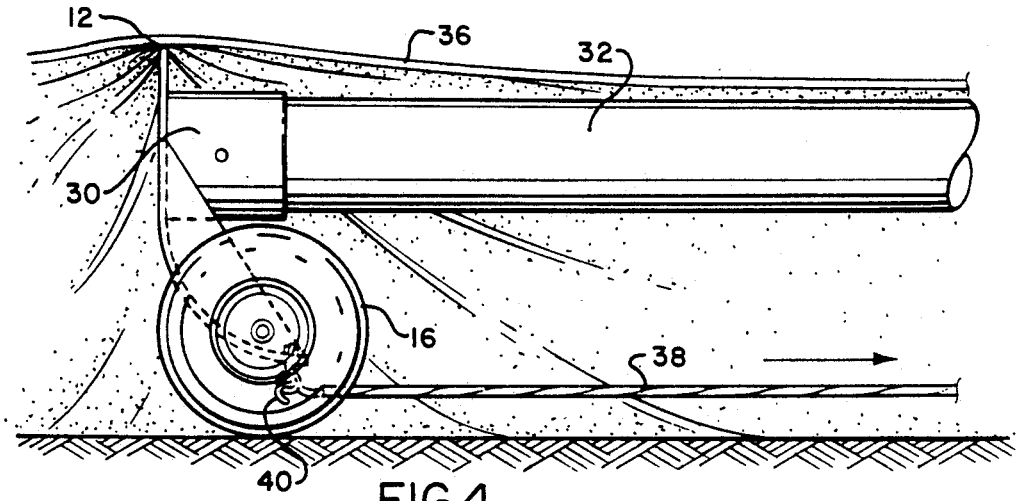
FIGS. 4, 5 and 6 illustrate use of the apparatus in hoisting a tent pole from a generally horizontal condition to an upward load bearing position.
Figures 5, 6:
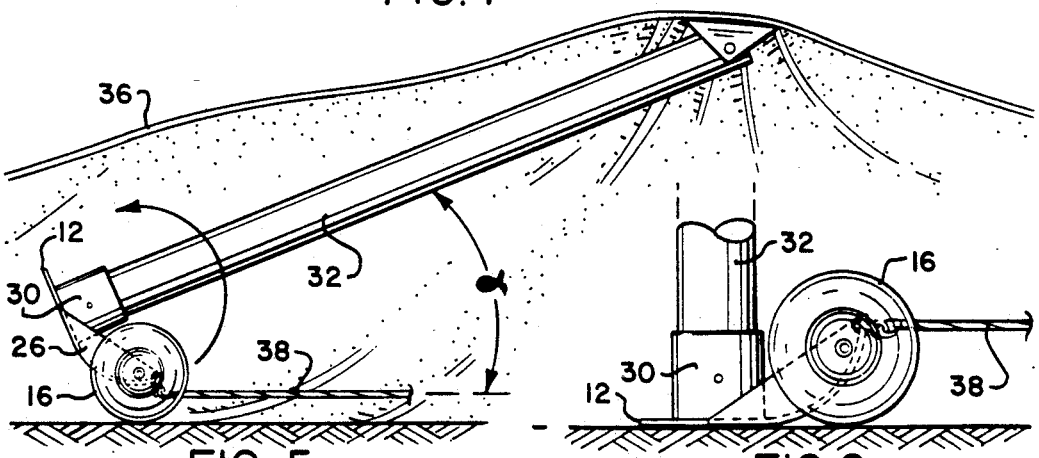

For the ensuing description of use of the hoisting apparatus of this invention in hoisting a tent pole, reference is now made to FIGS. 4 through 6. Initially, when it is desired to utilize the apparatus for raising a tent pole, the tent fabric 36 is stretched out in a generally horizontal position and the apparatus is placed under the tenting material with the lower end of the tent pole to be hoisted positioned within the guide tube 30 as shown in FIG. 4. Also, at this time it is to be noted that the flat portion 20 of the base plate extends generally vertically of the ground plane. Also, at this time the upper end of the tent pole is secured to the tent material at an appropriate point for achieving satisfactory load bearing function. A cable 38 with a hook 40 on one end is releasably secured within the eye bolt 24 and the apparatus 10 is moved in the correct direction in order to initiate hoisting of the pole (FIG. 5). During the hoisting movement, as the apparatus 10 is moved in the direction shown by the arrow, the apparatus rotates about the axle 34 gradually increasing the angle of hoist until the tent pole is at its vertical position with respect to ground plane (FIG. 6) at which time the tent pole is fully hoisted. At this time, the cable hook is disconnected from the eye bolt and the wheels may be removed for use with other tent pole hoisting apparatus, if desired. Optionally, the wheels may be left on the apparatus.

Although the present invention has been described in connection with a preferred embodiment, it is to be understood that those skilled in the appertaining art may effect changes which come within the spirit of the invention described and within the scope of the appended claims.

What is claimed is:

1. Apparatus for hoisting a tent pole with respect to a ground plane, comprising:

base plate means including a generally rectangular metal sheet having a portion adjacent an edge formed into a curve and relatively flat portion;

first and second reinforcing plates secured respectively to opposite edges of the rectangular metal sheet and extending across at ,least part of the curved portion;

a hollow guide tube having one end affixed to the base plate means and an outer open end, said tube having an inner diameter such as to enable ready receipt of the tent pole thereon;

an axle mounted on the base plate means, said axle extending generally parallel to an axis of curvature of the base plate curved portion; and a pair of wheels rotatably mounted on the axle.

2. Apparatus as in claim 1, in which the axle is mounted to the reinforcing plates at such a position that the wheels barely touch a ground plane when the metal flat portion contactingly engage the same ground plane.

3. Apparatus as in claim 1, in which the guide tube extends normally away from the metal sheet flat portion and on the same side as the curved portion.

4. Apparatus as in claim 1, in which there if further provided eye bolt means on the base plate means curved portion so located that a pulling force applied thereto parallel tot he ground plane will tend to rotate the base plate means about the axle orienting the guide tube axis toward a position normal to the ground plane.

* * * * *